US008931391B2

(12) United States Patent
Kocher

(10) Patent No.: US 8,931,391 B2
(45) Date of Patent: Jan. 13, 2015

(54) GAP ARMOR

(76) Inventor: Robert Kocher, McLean, VA (US)

( * ) Notice: Subject to any disclaimer, the term of this patent is extended or adjusted under 35 U.S.C. 154(b) by 136 days.

(21) Appl. No.: 12/216,616

(22) Filed: Jul. 8, 2008

(65) Prior Publication Data

US 2012/0180637 A1 Jul. 19, 2012

Related U.S. Application Data

(60) Provisional application No. 60/960,100, filed on Sep. 14, 2007.

(51) Int. Cl.
*F41H 7/00* (2006.01)
*F41H 7/04* (2006.01)

(52) U.S. Cl.
CPC ..... *F41H 7/042* (2013.01); *F41H 7/044* (2013.01); *F41H 7/048* (2013.01)
USPC ..... 89/36.08; 89/929

(58) Field of Classification Search
USPC ..... 89/36.01–36.04, 36.08, 36.09, 929
See application file for complete search history.

(56) References Cited

U.S. PATENT DOCUMENTS 1,358,579 A * 11/1920 Ross ..... 89/40.03
1,438,878 A * 12/1922 Tomassette ..... 89/40.03
1,865,882 A * 7/1932 Palmer ..... 89/40.03
4,158,986 A * 6/1979 Appelblatt et al. ..... 180/271
H0000129 H * 9/1986 Hansen ..... 89/36.04
H0000219 H * 2/1987 Sayles ..... 156/169
4,716,810 A * 1/1988 DeGuvera ..... 89/36.02
4,738,184 A * 4/1988 Bohne et al. ..... 89/36.08
5,070,764 A * 12/1991 Shevach et al. ..... 89/36.17
5,217,185 A * 6/1993 Rucker ..... 244/121
5,499,568 A * 3/1996 Turner ..... 89/36.08
7,080,587 B2 * 7/2006 Benyami et al. ..... 89/36.08
7,458,306 B2 * 12/2008 Singh et al. ..... 89/36.02
7,685,924 B2 * 3/2010 Barbe et al. ..... 89/36.09
7,997,182 B1 * 8/2011 Cox ..... 89/36.09
2005/0257677 A1 * 11/2005 Ravid et al. ..... 89/36.02
2007/0186762 A1 * 8/2007 Dehart et al. ..... 89/36.09

FOREIGN PATENT DOCUMENTS

DE 3206794 A1 * 9/1983

* cited by examiner

*Primary Examiner* — Reginald Tillman, Jr.
(74) *Attorney, Agent, or Firm* — Andrew Wichmann

(57) ABSTRACT

An armored vehicle with heavy side armor boxes and angled undercarriage armor, utilizing the chassis of overmatch armored vehicles, with a crew compartment for two, a rear door entry, and a blast gap between the side armor and crew compartment. This configuration provides for explosively formed penetrator (EFP) and improvised explosive device (IED) defeat and high levels of crew and vehicle survivability. This configuration allow a light vehicle frame such as a light pick up truck or military HMMWV to withstand very large mine, EFP, IED, and rocket propelled threats.

16 Claims, 6 Drawing Sheets

GAP ARMOR

CROSS-REFERENCE AND CLAIM OF PRIORITY TO RELATED APPLICATIONS

Provisional patent application No. 60/960,100 filing date: 14 Sep. 2007.

FEDERALLY SPONSORED RESEARCH

Not Applicable

SEQUENCE LISTING

Not Applicable

BACKGROUND OF THE INVENTION

1. Field of the Invention

This Invention generally relates to vehicle armor, specifically to an improved armor system to defeat explosive threats.

2. Prior Art

The initial fixes in 2003 to High Mobility Multipurpose Wheeled Vehicles (HMMWV)s have not been adapted to the growing number of threats with growing destructive capabilities emerging in combat areas such as Iraq. The simple and most common Improvised Explosive Device (IED) in 2003 consisted of an artillery round alongside a road with a wired or wireless remote detonator. In 2007 U.S. Forces are facing more significant threats, such as Explosively Formed Penetrators (EFP)s, designed to kill tanks, Bradleys, Light Armored Vehicles (LAV)s, Strikers, Mine Resistant Ambush Protected (MRAP) I Armored Vehicles, and significant overmatch for armored HMMWVs. New MRAP armored vehicles are designed to carry six to ten soldiers, providing the enemy with a larger target. Threats significantly overmatch all light armored vehicles. Underbody blasts significantly overmatch light armored vehicles, partly because such vehicles typically have flat bottoms and are low to the ground, partly because these existing vehicles' undercarriage provides no path for the explosive energy from an under-the-vehicle IED or other major explosive to escape and partly because of armoring that is insufficient against the explosive power used. Additionally, crew size is growing with new vehicles, the result of which is just a larger target.

Basic physics and engineering analysis show the importance of deflecting, rather than absorbing, the energy of a blast. The invention described in this disclosure facilitates deflecting and diverting the energy of the blast so that armoring need only protect from the portion of the blast that remains undeflected and undiverted.

Objects and Advantages

Accordingly, several objects and advantages of the invention are:

(a) to provide protection and prevent even very large blast and ballistic threat from entering the crew compartment;

(b) to provide underbody blast protection that can survive blasts that typically no light vehicle can withstand;

(c) to reduce the crew size, which would reduce the maximum number of casualties from a single IED event; and (d) to enable HMMWVs that have been modified in the manner taught in this invention to become much more effective in protecting the occupants of such vehicles.

SUMMARY

In accordance with the present invention a gap armor system comprises a vehicle built on a light vehicle chassis such as an HMMVW, side armor boxes, slots between side armor and crew compartment to channel the energy of a blast away from the vehicle, and angled bottom armor on the chassis and armor boxes.

DRAWINGS

Figures

REFERENCE NUMERALS

| | | | |
|---|---|---|---|
| 10 | gap | 15 | HMMVW or light vehicle chassis |
| 20 | crew compartment | 25 | undercarriage v-hull |
| 30 | side armor box | 35 | angled undercarriage armor |
| 40 | gun turret | 45 | heavy glass side armor |
| 50 | hatch | 55 | door to crew compartment |
| 60 | connecting structure | | |

DETAILED DESCRIPTION

Preferred Embodiment

Figure 1:
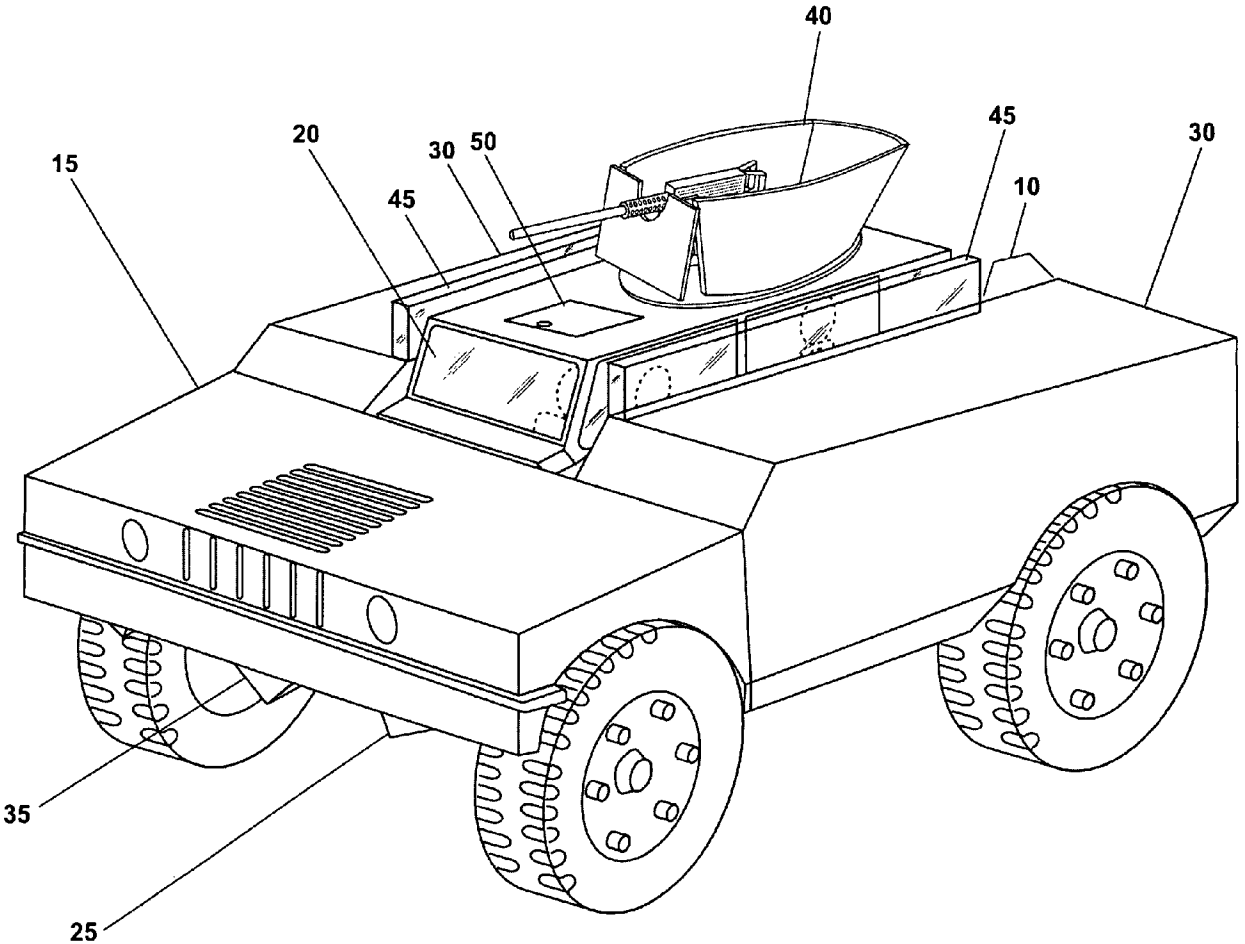
FIG. 1 shows an angled view of the entire gap armored vehicle.
Figure 2:
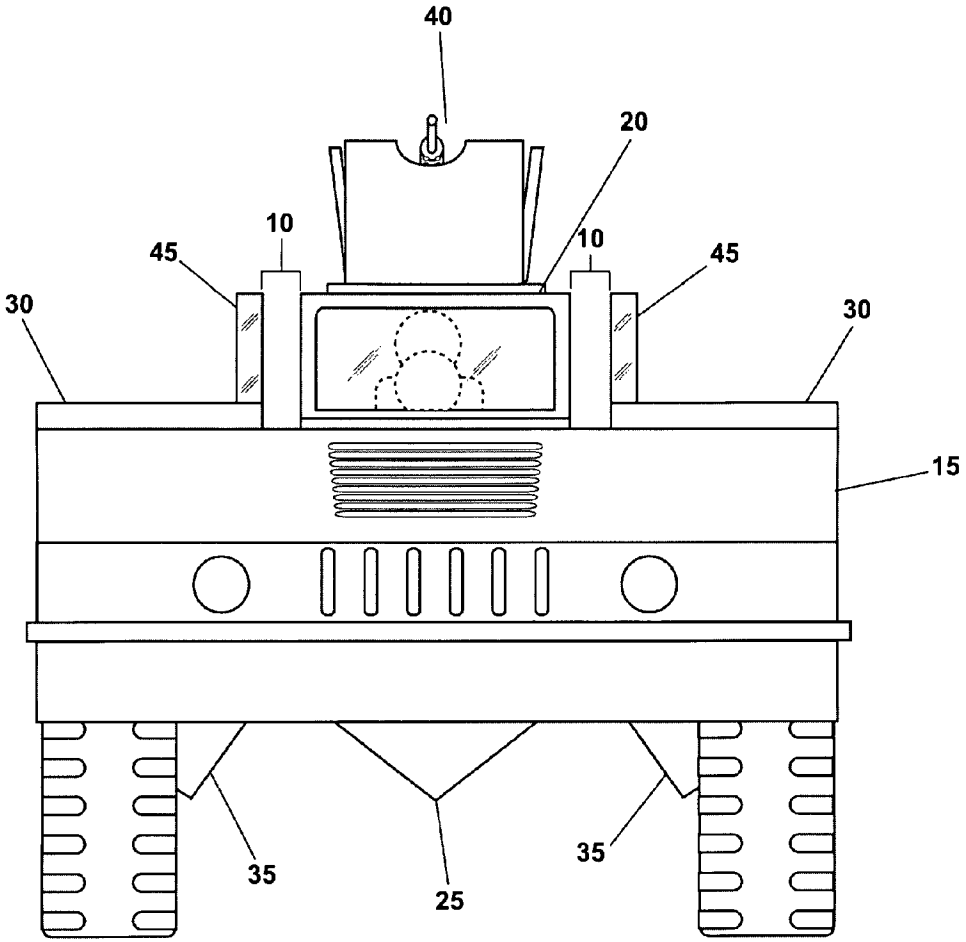
FIG. 2 shows the front of the gap armor vehicle.
Figure 3:
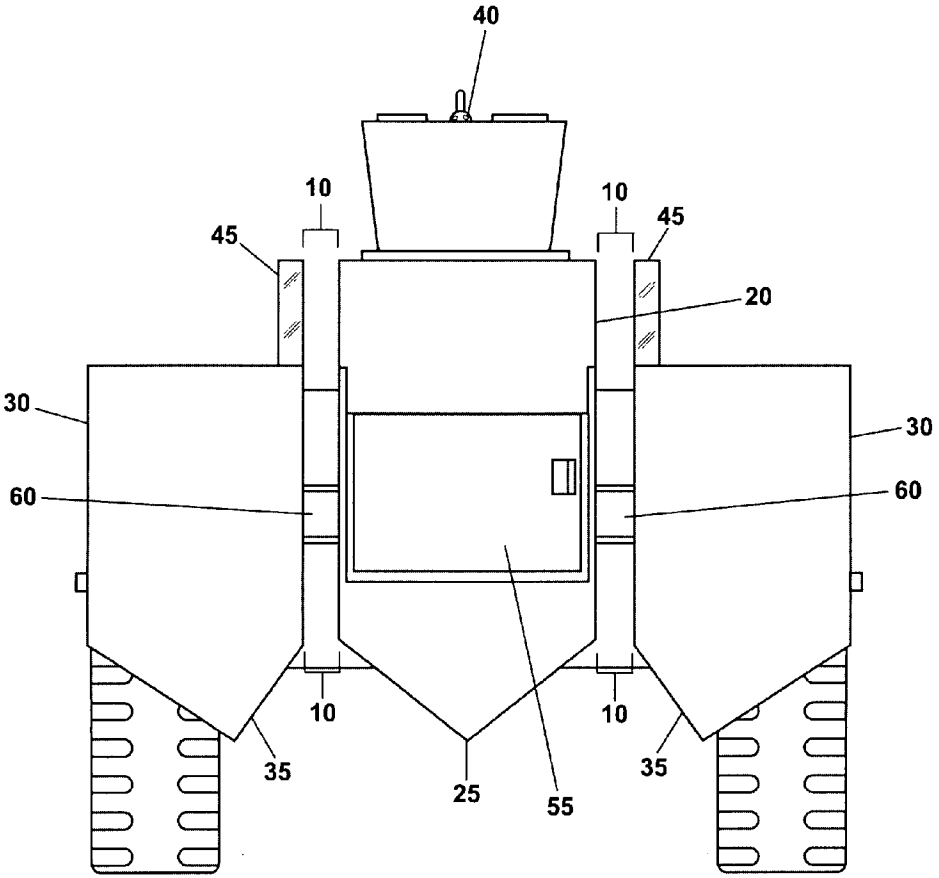
FIG. 3 shows the rear of the gap armor vehicle.

A preferred embodiment of a gap armor vehicle is illustrated in FIG. 1 (angled view), FIG. 2 (front view), and FIG. 3 (rear view). FIG. 1 shows an angled view of the invention. The light vehicle 15 chassis is connected to the crew compartment 20 and side armor boxes 30 in a way to create a gap 10 between the crew compartment 20 and each side armor boxes 30. The side armor boxes 30 may be filled with any number of materials to defeat threats, comprising on-site materials, eroding particles, metals, and other threat defeating materials. The heavy glass side armor 45, attached to the side armor boxes 30, provides additional armor to threats to the side of the crew compartment where the windows are located. The crew compartment 20 is detailed with a gun turret 40 and hatch 50. The underside of the vehicle shows a v-hull 25 connected to the underside of the chassis and angled undercarriage armor 35 connected to the underside of each armor box 30 for undercarriage blasts.

FIG. 2 shows essentially the same parts of the gap armor vehicle, but at an angle to illustrate the placement of the undercarriage v-hull 25 aligned with the center of the vehicle and angled undercarriage armor 35 connected to the side armor boxes 30 to direct ground blasts to the gap between the side armor boxes 30 and the crew compartment 20.

FIG. 3 shows the rear of the gap armor vehicle. The crew compartment 20 has a rear door 55 having dimensions to accommodate a fully armored soldier and placed at the rear so that the crew compartment 20 is highly protected on the sides by the side armor boxes 30. The side armor boxes 30 are connected to the vehicle at the HMMWV chassis 15 and another connecting structure 60 comprising a system of I-beams.

Figure 4:
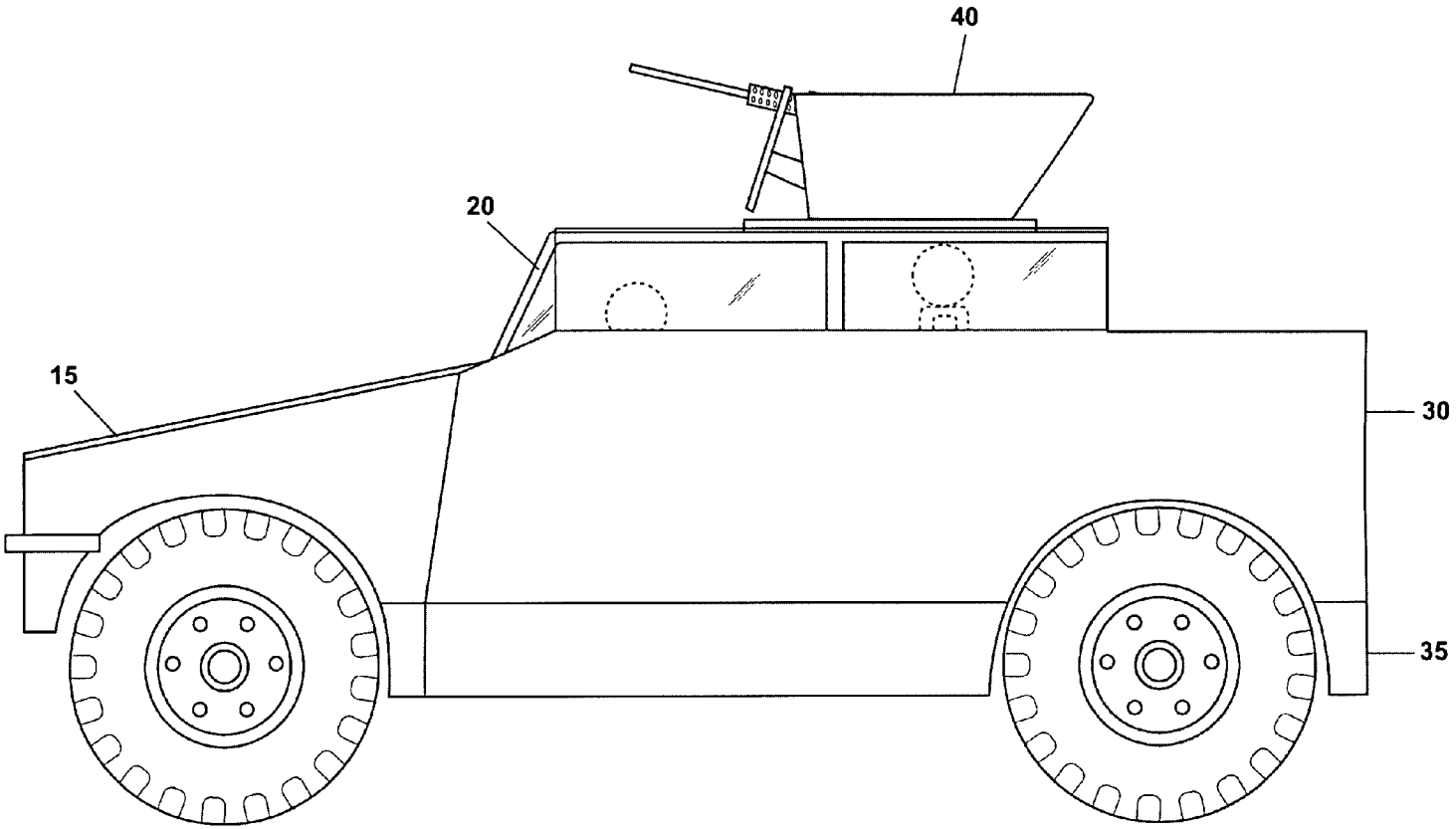
FIG. 4 shows a side of the gap armor vehicle.

FIG. 4 shows the side of the gap armor vehicle, illustrating that the side armor box 30 provides armored coverage for most of the crew compartment 20. It also illustrates that the angled undercarriage armor 35 provides an additional, thick armor to the underside of the side armor box 30.

Figure 5:
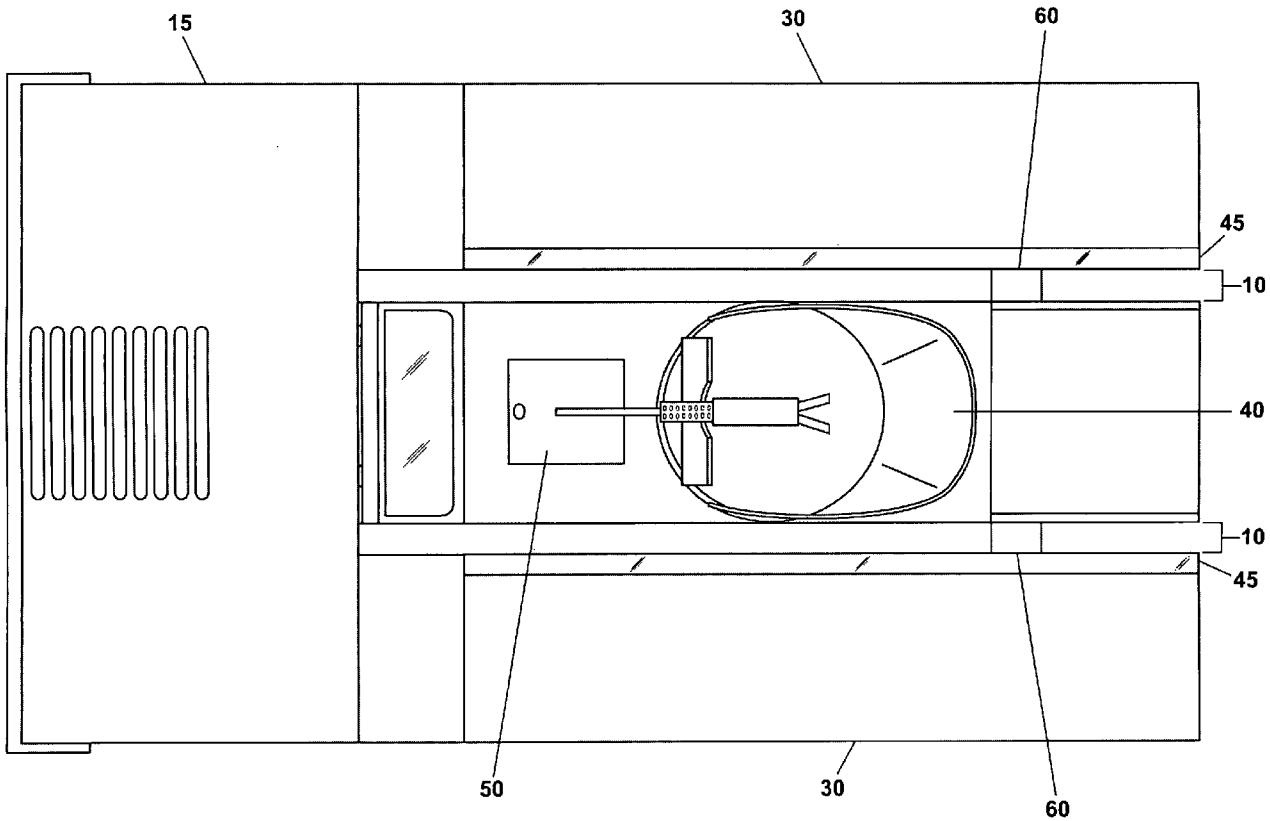
FIG. 5 shows the top of the gap armor vehicle.

FIG. 5 shows essentially the same embodiment of the invention as FIGS. 2 and 3, but from the top view and without the view of the undercarriage armor system.

Figure 6:
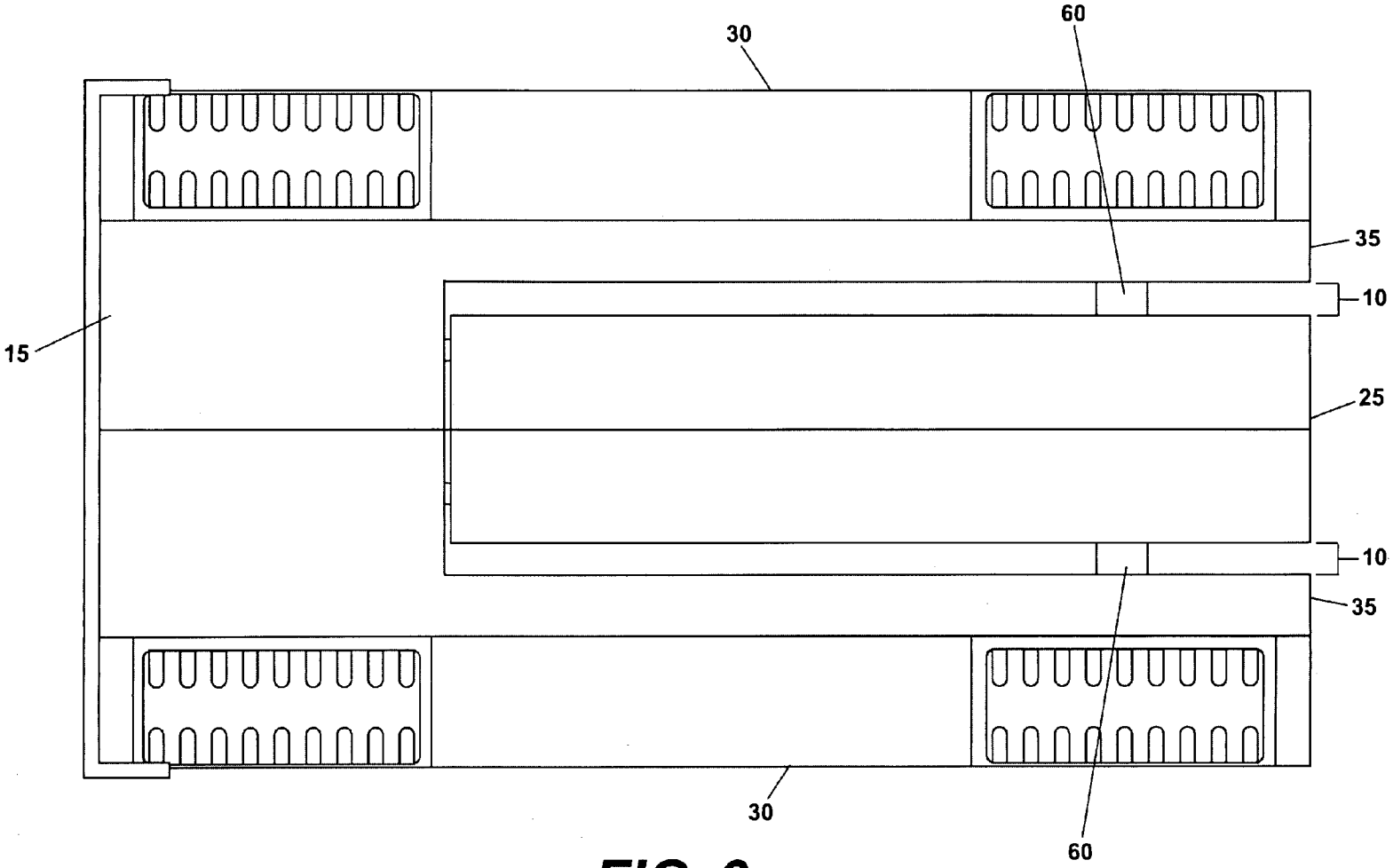
FIG. 6 shows the bottom of the gap armor vehicle.

FIG. 6 shows the underside of the gap armor vehicle. This figure illustrates the location and approximate dimensions of the undercarriage armor and gaps between the side armor boxes 30 and the crew compartment 20. The v-hull 25 extends from the HMMWV chassis 15 to the end of the crew compartment 20. The length of the angled undercarriage armor 35, connected to the side armor boxes 30, runs from wheel to wheel.

Operation

In operation the gap armor vehicle protects against emerging combat threats of IEDs and EFPs and other ground blasts. Utilizing HMMWV chassis 15 allows the thousands of HMMWVs that cannot survive current threats to have a continued use in theater and not go to waste. The HMMWV chassis 15 along with the connection structure 60 attach to side armor boxes 30, which will give the vehicle added survivability and defeat mechanisms for side blasts.

The side armor boxes 30 do not attach flush with the crew compartment 20. The connection structure 60 assists in maintaining a gap between a side armor box 30 and the crew compartment 20. This gap provides the essential mechanism to the entire vehicle and, more importantly, the crew to survive undercarriage blasts. The connection structure 60 may also be of a material that would allow for the side armor boxes 30 and crew compartment 20 to separate during a blat to increase the chance of the crew surviving. The side armor boxes 30 may each have a heavy glass side armor 45 to protect the crew and still allow them visibility from the sides. Each side armor box 30 may be filled with a variety of materials to defeat threats, including, but not limited to, on-site materials, eroding particle materials, explosive pills, metals, standard armor material, and other threat defeating materials. The side armor boxes 30 are constructed in such a way as to allow for easy, lighter transportation of vehicles and vehicle armor, and method for adjusting armor for varying levels and location of a given threat.

The crew compartment 20 is made of lighter armor and is sized for two fully armored soldiers. The entry door 55 to the crew compartment is located in the rear so that the sides of the crew compartment 20 are fully armored, as the side of a vehicle is more likely to receive a blast or other threat than the rear. The crew has access and control of the gun turret 40 stationed externally above the crew compartment 20. The crew compartment 20 is also equipped with an extra hatch 50 for driver visibility if visibility through the front window is minimized or blocked.

The undercarriage of the vehicle provides additional armor and threat defeating mechanisms. Under the crew compartment 20 is a v-hull 25, which provides additional armor and a redistribution of the blast force of a threat attacking the vehicle from below. The angled undercarriage armor 35 attaches to the underside of each side armor box 30 to provide additional armor and redistribute blast force of a threat attacking the vehicle from below. The v-hull 25 combined with the angled undercarriage armor 35 work together to redistribute blast forces from ground threats below the vehicle as well as redirect blast forces to the gap 10 between the side armor boxes 30 and the crew compartment 20. The undercarriage structures give the vehicle higher survivability potential.

Scope of Invention

Thus the reader will see that an armored vehicle with gaps between the side armor and the crew compartment provides a highly survivable vehicle capable of defeating a variety of threats. The crew compartment is small to accommodate two persons to minimize the target for enemy combatants. The undercarriage consists of a v-hull and angled undercarriage armor to defeat threats, provide additional protection under the crew compartment and side armor boxes, and redirect blasts to the gaps between the side armor boxes and crew compartment.

The invention claimed is:

1. A gap armor vehicle, comprising a chassis having four or more wheels;

a crew compartment having a center, at least two sides, a top, a front, a rear, an underside, and connected to the chassis;

a v-hull connected to the underside of the crew compartment, the v-hull extending from the front to the rear of the crew compartment, the v-hull aligned with the center of the crew compartment when viewed from the front, the v-hull extending to each side of the crew compartment;

at least one side armor box having at least two sides, a top, a front, a rear, and an underside;

angled undercarriage armor that is connected to the underside of the at least one side armor box;

at least one gap structure, comprising one side of the crew compartment, one side of the at least one side armor box, a channel between the one side of the crew compartment and the one side of the at least one side armor box, and an opening at the top and underside of the crew compartment, wherein the at least one gap structure is configured such that a force of a ground blast beneath the underside of the crew compartment is directed through the channel, between the crew compartment and the at least one side armor box, and wherein the at least one gap structure, when viewed from the front, is within the narrowest width between any two of the four or more wheels.

2. The gap armor vehicle of claim 1, wherein the channel has a width extending from the at least one side of crew compartment to the side of the at least one side armor box of between 4 and 18 inches.

3. The gap armor vehicle of claim 1, wherein the crew compartment further comprises a two person seating arrangement having a first person in front of a second person.

4. The gap armor vehicle of claim 1, wherein the at least one side armor box has a width extending from a first side to a second side of between 4 and 24 inches.

5. The gap armor vehicle of claim 1, wherein the chassis is a light military vehicle chassis.

6. The gap armor vehicle of claim 1, wherein the crew compartment is armored, and the crew compartment is more lightly armored than the at least one side armor box.

7. A gap armor vehicle, comprising a chassis having four or more wheels;

a crew compartment having a center, at least two sides, a top, a front, a rear, an underside, and connected to the chassis and a crew seating arrangement, consisting essentially of a first person in front of a second person;

a v-hull connected to the underside of the crew compartment, the v-hull extending from the front to the rear of the crew compartment, the v-hull aligned with the center of the crew compartment when viewed from the front, the v-hull extending to each side of the crew compartment;

at least one side armor box having at least two sides, a top, a front, a rear, and an underside;

angled undercarriage armor that is connected to the underside of the at least one side armor box;

at least one gap structure, comprising one side of the crew compartment, one side of the at least one side armor box, a channel between the one side of the crew compartment and the one side of the at least one side armor box, and an opening at the top and underside of the crew compartment, wherein the at least one gap structure runs parallel to the crew compartment from the front to the back the crew compartment, wherein the at least one gap structure is configured such that a force of a ground blast beneath the underside of the crew compartment is directed through the channel, between the crew compartment and the at least one side armor box, and wherein the at least one gap structure, when viewed from the front, is within the narrowest width between any two of the four or more wheels.

8. The gap armor vehicle of claim 7, wherein the channel has a width extending from the at least one side of crew compartment to the side of the at least one side armor box of between 4 and 18 inches.

9. The gap armor vehicle of claim 7, wherein the at least one side armor box has a width extending from a first side to a second side of between 4 and 24 inches.

10. The gap armor vehicle of claim 7, wherein the chassis is a light military vehicle chassis.

11. The gap armor vehicle of claim 7, wherein the crew compartment is armored, and the crew compartment is more lightly armored than the at least one side armor box.

12. A gap armor vehicle, comprising a chassis having four or more wheels;

a crew compartment having a center, at least two sides, a top, a front, a rear, an underside, and connected to the chassis;

a v-hull connected to the underside of the crew compartment, the v-hull extending from the front to the rear of the crew compartment, the v-hull aligned with the center of the crew compartment when viewed from the front, the v-hull extending to each side of the crew compartment;

at least one side armor box having at least two sides, a top, a front, a rear, and an underside;

at least one gap structure, comprising one side of the crew compartment, one side of the at least one side armor box, a channel between the one side of the crew compartment and the one side of the at least one side armor box, and an opening at the top and underside of the crew compartment, wherein the at least one gap structure is configured such that a force of a ground blast beneath the underside of the crew compartment is directed through the channel, between the crew compartment and the at least one side armor box, and wherein the at least one side armor box, when viewed from the front, has at least one side located completely within the narrowest width between any two of the four or more wheels.

13. The gap armor vehicle of claim 12, wherein the channel has a width extending from the at least one side of crew compartment to the side of the at least one side armor box of between 4 and 18 inches.

14. The gap armor vehicle of claim 12, wherein the crew compartment further comprises a two person seating arrangement having a first person in front of a second person.

15. The gap armor vehicle of claim 12, wherein the at least one side armor box has a width extending from a first side to a second side of between 4 and 24 inches.

16. The gap armor vehicle of claim 12, wherein the chassis is a light military vehicle chassis.

* * * * *